US006218025B1

(12) United States Patent
Fromm et al.

(10) Patent No.: US 6,218,025 B1
(45) Date of Patent: Apr. 17, 2001

(54) SINTERING ELECTRODE

(75) Inventors: Dietrich Fromm, Warngau; Bernhard Altmann, Langerringen; Wolfram Graser, Munich; Peter Schade, Schwabmuenchen, all of (DE)

(73) Assignee: Patent- Truchand-Gesellschaft fuer Elektrische Gluelampen mbH

( * ) Notice: Subject to any disclaimer, the term of this patent is extended or adjusted under 35 U.S.C. 154(b) by 0 days.

(21) Appl. No.: 09/125,393

(22) PCT Filed: Nov. 11, 1997

(86) PCT No.: PCT/DE97/02640

§ 371 Date: Aug. 18, 1998

§ 102(e) Date: Aug. 18, 1998

(87) PCT Pub. No.: WO98/27575

PCT Pub. Date: Jun. 25, 1998

(30) Foreign Application Priority Data

Dec. 18, 1996 (DE) ..... 196 52 822

(51) Int. Cl.[7] ..... H01J 61/00; H01J 9/00; B22F 7/00

(52) U.S. Cl. ..... 428/544; 75/245; 75/247; 75/248; 313/311; 313/346 R; 419/8; 419/19; 419/20; 419/23; 419/27; 419/38; 419/66; 428/550; 428/553; 428/566; 428/636; 428/637; 428/655; 428/656; 428/660; 428/662; 428/663; 428/664; 428/665; 428/670; 445/46

(58) Field of Search ..... 428/544, 550, 428/553, 566, 636, 637, 655, 656, 660, 662, 663, 664, 665, 670; 419/2, 8, 19, 20, 23, 27, 38, 66; 75/245, 247, 248; 445/46; 313/311, 346 R

(56) References Cited

U.S. PATENT DOCUMENTS

| | | | |
|---|---|---|---|
| 3,244,929 | 4/1966 | Kuhl | 313/311 |
| 4,303,848 | * 12/1981 | Shimizu et al. | 313/346 R |
| 4,830,822 | 5/1989 | Ward | 419/23 |
| 5,418,070 | 5/1995 | Green | 428/550 |

FOREIGN PATENT DOCUMENTS

| | | |
|---|---|---|
| 2935447 | 3/1980 | (DE) . |
| 292764 | 8/1991 | (DE) . |
| 4206909 | 9/1993 | (DE) . |
| 0068265 | 1/1983 | (EP) . |
| 0288118 | 10/1988 | (EP) . |
| 0791950 | 8/1997 | (EP) . |
| 639797 | 7/1950 | (GB) . |
| 816135 | 7/1959 | (GB) . |
| 977545 | 12/1964 | (GB) . |
| 9602062 | 1/1996 | (WO) . |

OTHER PUBLICATIONS

"Modern dispenser cathodes", J.L. Cronin, Ph. D., IEE Prodeedings–1/Solid–State and Electron Devices, vol. 128, No. 1, Feb. 1981, pp. 19–32, XP002062073.

"Overview of Powder Injection Molding", P.J. Vervoort et al., Advanced Performance Materials, vol. 3, 1996, pp. 121–151, XP002062074. (No Month).

"New Types of Metal Powders", Henry H. Hausner, Metallurgical Society Conferences, vol. 23, Cleveland, Ohio Oct. 24, 1963, #4.

* cited by examiner

*Primary Examiner*—Deborah Jones
*Assistant Examiner*—Robert R. Koehler
(74) *Attorney, Agent, or Firm*—William H. McNeill

(57) ABSTRACT

A sintered electrode of high-melting metal (for example tungsten) is produced from spherical metal powder having a well defined particle size. The mean particle size is from 5 to 70 $\mu$m. The particle size distribution covers a range from at most 20% below to at most 20% above the mean particle size.

13 Claims, 1 Drawing Sheet

SINTERING ELECTRODE

CROSS-REFERENCE

The present application is closely related to the parallel application U.S. Ser. No. 09/149,419, filed Nov. 11, 1997.

TECHNICAL FIELD

This invention relates to sintered electrodes and more particularly to sintered electrodes for high-pressure discharge lamps and still more particularly to high-pressure sodium lamps.

PRIOR ART

DE-A 42 06 909 discloses a thermionically emitting cathode element for vacuum electron tubes which is produced from spherical particles having a mean particle size of less than 1 μm. From 5 to 90% of the total volume of the sintered electrode consists of unfilled pores which are open to the surroundings. The distances between adjacent particles (grains) are less than 1 μm.

U.S. Pat. No. 3,244,929 discloses a sintered electrode which contains tungsten plus proportions of emitter material such as oxides of aluminium, barium, calcium or thorium. The sintered body is located on a rigid core pin of solid material.

U.S. Pat. No. 5,418,070 discloses a cathode comprising a porous tungsten matrix in whose pores emitter material is incorporated. The pores are produced by filling the green body of the matrix with liquid copper which is later dissolved out again. The disadvantage of this method is that the pores have irregular shapes and their properties are undefined. The production procedure is complicated and time-consuming.

DD Patent 292 764 discloses a cermet sintered body comprising a mixture of tungsten and thorium oxide or alkaline earth metal oxide, in which the porosity of the sintered body is controlled during production by defined use of a binder. The particle size of the cermet powder is from 80 to 550 μm.

A great problem associated with the known sintered electrodes is that their porosity does not remain constant over their operating life since the sintering process continues during operation of the electrode because of the high temperature to which it is exposed. For this reason, such lamps have poor maintenance of the light flux over the operating life.

Owing to this serious disadvantage, sintered electrodes have hitherto not been able to become established in a wide range of applications. Instead, the advice given hitherto has been to use helical coil electrodes having a core pin of thoriated tungsten or pin electrodes of thoriated tungsten. They have, in each case, hitherto been produced from compact, solid material.

DESCRIPTION OF THE INVENTION

It is an object of the present invention to provide a sintered electrode which does not make use of thorium and achieves a relatively long operating life and also a relatively low arc instability.

The sintered electrode of the invention for high-pressure discharge lamps comprises a sintered body of one of the high-melting metals tungsten, tantalum, osmium, iridium, molybdenum or rhenium or an alloy of these metals. In addition, an oxidic dopant known per se, for example an oxide of lanthanum or yttrium, can be added in a amount of up to 5% by weight to the metal or the alloy.

The sintered body is produced from an essentially spherical powder of the metal or the alloy whose mean particle size is from 2 to 100 μm, where the particle size distrbution covers a range from at most 20% below to at most 20% above the mean and from 10 to 40% by volume of the total volume of the sintered electrode consists of pores open to the surroundings.

The pores can be unfilled or contain emitter additives. Typical emitter additives are oxides of the alkaline earth metals, for example of barium, calcium, strontium and mixtures thereof. Also suitable are aluminates and oxides of hafnium or zirconium or of the rare earth metals (in particular Sc, Y, La, Ce, Nd, Gd, Dy and Yb).

The mean particle size of the spherical powder is preferably from 5 to 70 μm.

In a particularly preferred embodiment, the particle size distribution covers a range from at most 10% below to at most 10% above the mean.

In particular the sintered body is fixed in a manner known per se on a core pin of solid metal. A particular advantage of this is that joining techniques such as soldering or welding are not necessary. The mechanical connection is produced purely by shrink fitting or sintering on.

Preferably, the material of the sintered body and of the core pin is essentially the same, for example pure tungsten. The sintered body can be unfilled or contain emitter additives (for example lanthanum oxide). The core pin can also be made of pure, potassium-doped tungsten or a rhenium-tungsten alloy.

In particular, the electrode can be made without use of thorium and is then not radioactive.

The electrode of the invention has a series of advantages:

The operational life of the high-pressure discharge lamps provided therewith is increased, the rise in the lamp operating voltage is reduced and maintenance of the light flux is significantly improved. In addition, the blackening of the wall of the discharge vessel is decreased. Furthermore, the lamps display decreased arc instability and flickering during operation. In addition, the production of the electrode is significantly simplified. Compared with conventional electrodes, the electrode coil is not needed.

A particularly advantageous process for producing a sintered body comprises the following process steps:

a) provision of an essentially spherical metal powder of one of the high-melting metals tungsten, tantalum, molybdenum, iridium, osmium or rhenium or an alloy of these metals, where the powder has the following properties:

the mean particle size of the metal powder is from 2 to 100 μm;

the particle size distribution covers a range from at most 20% (typically 10%) below to at most 20% (typically 10%) above the mean; in particular, the spherical particles of metal powder used for this purpose are monocrystalline;

b) pressing the powder; a typical value of the pressure employed is from 100 to 400 MPa;

c) sintering of the compact at a temperature of about 0.6 to 0.8 times the melting point of the metal used (given in Kelvin).

The powder is preferably monocrystalline. In process step b), the powder can, in particular, be pressed around a core pin.

Process step c) is, for example in the case of tungsten, preferably carried out at temperatures of from 2,500 to 2,800 K. In the case of an alloy, the melting point in this context is that of the lowest-melting component.

Owing to the spherical shape of the metal powder, good flow properties are obtained when filling the pressing mould (die). As a result, pressing can advantageously be carried out without addition of a binder. This saves an additional processing step and avoids possible contamination.

Another advantageous method is metal injection moulding. This technique is described in more detail in the parallel application Ser. No. 09/149,419. It can be used in modified form for the present invention too. The process sequence can be briefly summarized thus: a suitable metal powder is mixed with sufficient plastic (the binder) for the starting material, which is in granulated form, to take on the flow properties of the plastic and to be able to be processed further by a method similar to plastics injection moulding by introducing it into an injection moulding tool having the contour of the desired future component. In order to obtain a metallic component, the green body is taken from the injection moulding tool and the binder is subsequently removed from the green body by means of heat or solvents. This step is known as dewaxing. The component is then sintered by methods of classical powder metallurgy to give a component having a very high density.

The essentially spherical metal powder is produced in a manner known per se, with rounded or virtually exactly spherical particles being able to be formed. An example is the carbonyl process (New Types of Metal Powders, Ed. H. Hausner, Gordon and Breach Science Publishers, New York 1963, published as Volume 23 of the series Metallurgical Society Conferences). Particularly good results are achieved using a monocrystalline metal powder.

The sphere-like powder particles of homogeneous size develop equilibrium surfaces in the form of polyhedra during sintering. For example, these can be [110] or [111] planes. It has surprisingly been found that these polyhedral surfaces do not sinter together any further, so that the porosity of this novel sintered body remains virtually constant over the operating life. It is a sponge body having an open porosity.

The way in which the sintered body works is illustrated below by means of an example in which the sintered body is produced from pure (i.e. $ThO_2$-free) tungsten.

The starting material is spherical W powder having a very uniform diameter, i.e. having a narrow particle size distribution. This homogeneity of the powder finally results in a high stability of the sintered body at high temperatures and leads to correspondingly stable conditions during the operating life of the lamp. The powder can, in particular, be pressed directly around a $ThO_2$-free core pin. It is subsequently sintered at the relatively low temperature of about 2350 (±100)° C. This low temperature, which corresponds to about 0.7 times the melting point of tungsten, gives a considerable energy saving compared with the customary sintering temperatures of 2800–3000° C. for compact tungsten material.

Further emitter additives are not necessary in many applications, but if required can be introduced into the voids or pores.

The residual porosity of the final sintered sponge electrode can be set in a targeted manner by means of the sphere size of the starting material. Preference is given to using sphere sizes of from 5 to 70 $\mu$m for the sponge electrode. This enables a residual porosity of from about 15 to 30% by volume to be achieved.

The particular advantages of the sponge electrode in the lamp are described below:

In the case of an electrode according to the invention, the discharge occurs over a large area of the electrode. The point discharge known from conventional electrodes, which there frequently leads to locally very high temperatures and to migration of the discharge point, is avoided. The temperature distribution on the entire sponge body is largely uniform. In contrast, a conventional electrode has a high temperature gradient. At the tip in particular, it has a temperature which is typically 500 K higher than in the rear part of the electrode.

After ignition of the lamp, the transition from a glow discharge to an arc discharge occurs more rapidly when using the sintered electrode than in the case of the conventional solid electrode, since heat conduction from the tip of the electrode in the direction of the pinch is greatly reduced as a result of the low contact area between the sintered grains of the sintered body.

In addition, in particular in the case of a vertical operating position, better heating of the discharge vessel adjacent the pinch seal is achieved in the case of the sponge electrode. The cause is the greater surface area of the electrode which radiates more light. Any reflection coating at the ends of the bulb can therefore be made smaller or omitted completely, giving a higher light flux.

FIGURES

The invention is illustrated below with the aid of an illustrative embodiment. In the figures:

FIG. 1 shows a cross-section of a sintered electrode

FIG. 2 shows a metal halide lamp with a sintered electrode.

DESCRIPTION OF THE DRAWINGS

The sintered electrode 1 shown in FIG. 1 for a 150 W lamp comprises a cylindrical sintered body 2 into whose half farthest from the discharge a solid core pin 5 of tungsten has been axially pressed. The sintered body 2 comprises tungsten which has been produced from spherical metal powder having a mean particle size of 10 $\mu$m. The particle size distribution covers a range from 10% below to 10% above the mean. The residual porosity is about 15% by volume.

The diameter of the core pin is about 0.5 mm, the external diameter of the sintered body is about 1.5 mm.

Figure 1:
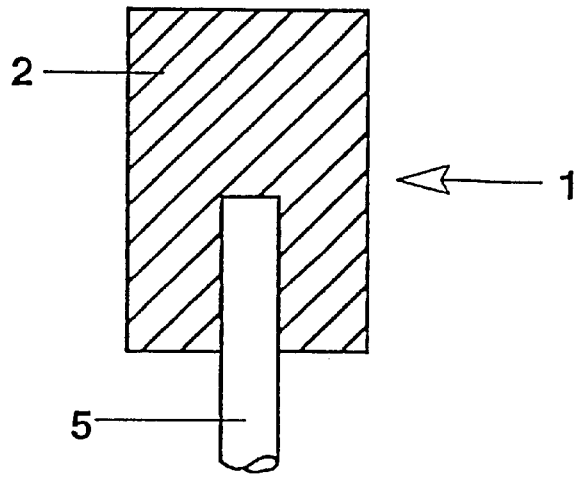
Figure 2:
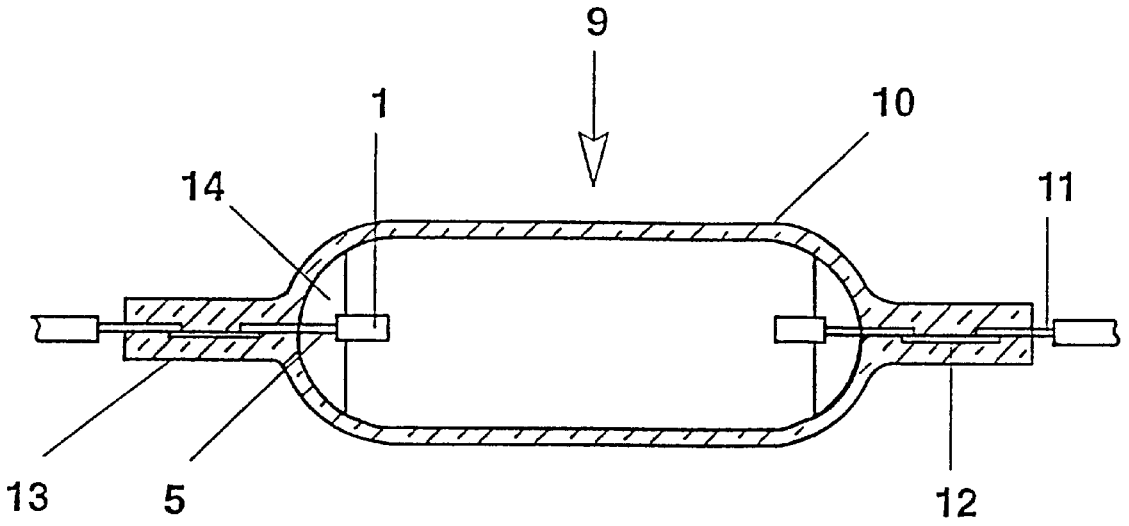
FIG. 2 shows, as an application example, a metal halide lamp 9 having a power of 150 W. It comprises a quartz glass vessel 10 which contains a metal halide filling. At both ends of this, external power leads 11 and molybdenum foils 12 are embedded in pinches 13. The core pins 5 of the electrodes 1 are fixed to the molybdenum foils 12. The electrodes project into the discharge vessel 10. The two ends of the discharge vessel are each provided with a heat-reflecting coating 14 of zirconium oxide.

In another illustrative embodiment, the electrode comprises a sintered body which is rounded at the discharge end or has a point. The sintered body comprises tungsten, while the pressed-in core pin comprises rhenium, rhenium-plated tungsten or molybdenum.

A particularly advantageous method of producing a sintered electrode according to the invention is based on the metal injection moulding process known per se. The principle is explained in detail in the parallel application No. Ser. No. 09/149,419. This parallel application is expressly incorporated by reference. An overview may be found in the article "Overview of Powder Injection Molding" by P. J. Vervoort et al., in: Advanced Performance Materials 3, pp. 121–151 (1996).

For the sintered electrode of the invention, the following specific process steps are used:

provision of an essentially spherical, in particular monocrystalline, metal powder of high-melting metal such as tungsten, tantalum, molybdenum, osmium, iridium or rhenium or an alloy of these metals, where the powder has the following properties:

the mean particle size of the metal powder is from 2 to 100 μm;

the particle size distribution covers a range from at most 20% below to at most 20% above the mean;

preparation of a feedstock mixture of powder and binder (often also referred to as wax) and possibly polymer;

injection of the mixture into an injection moulding tool;

chemical and thermal removal of the binder (dewaxing);

sintering at a temperature of about 0.6 to 0.8 times the melting point of the metal used.

In a particularly preferred embodiment, the mixture is injected around a core pin in the injection moulding tool and joined to this core pin during sintering.

Such electrodes have a significantly better operating life. Investigations on metal halide lamps having a power of 150 W show that when using metal powders having a particle size of 5 or 20 μm, the maintenance of the light flux after 1000 hours is in each case 95% of the initial light flux. In contrast thereto, a drop in the light flux after 1000 hours to values of from 83 to 90% is observed in the prior art (conventional pin electrode of doped tungsten material).

What is claimed is:

1. Sintered electrode for high-pressure discharge lamps, comprising a sintered body of one of the high-melting metals tungsten, tantalum, osmium, iridium, molybdenum or rhenium or an alloy of these metals, characterized in that the sintered body has been produced from monocrystalline powder of the metal or the alloy whose mean particle size is from 2 to 100 μm, where the particle size distribution covers a range from at most 20% below to at most 20% above the mean and from 10 to 40% by volume of the total volume of the sintered electrode consists of pores which are open to the surroundings.

2. Sintered electrode according to claim 1, characterized in that the pores are unfilled or contain emitter additives.

3. Sintered electrode according to claim 1, characterized in that the mean particle size is from 5 to 70 μm.

4. Sintered electrode according to claim 1, characterized in that the sintered body is fixed on a core pin of solid metal.

5. Sintered electrode according to claim 4, characterized in that the material of the sintered body and the core pin is essentially the same.

6. Sintered electrode according to claim 1, characterized in that the metal contains up to 5% by weight of dopants.

7. Process for producing a sintered electrode according to claim 1, comprising the following process steps:

provision of monocrystalline, metal powder of high-melting metal selected from the group consisting of such as tungsten, tantalum, molybdenum, osmium, iridium or rhenium or an alloy of these metals, where the powder has the following properties:

the mean particle size of the metal powder is from 2 to 100 μm;

the particle size distribution covers a range from at most 20% below to at most 20% above the mean;

pressing the powder;

sintering at a temperature of about 0.6 to 0.8 times the melting point of the metal used.

8. Process according to claim 7, characterized in that the powder is pressed around a core pin and is joined to said core pin during sintering.

9. Process according to claim 7, characterized in that pressing is carried out without addition of a binder.

10. A Process for producing a sintered electrode according to claim 1, comprising the following process steps:

provision of monocrystalline, metal powder of high-melting metal selected from the group consisting of such as tungsten, tantalum, molybdenum, osmium, iridium or rhenium or an alloy of these metals, where the powder has the following properties:

the mean particle size of the metal powder is from 2 to 100 μm;

the particle size distribution covers a range from at most 20% below to at most 20% above the mean;

preparation of a feedstock mixture of powder and binder;

injection of the mixture into an injection moulding tool;

chemical and thermal removal of the binder;

sintering at a temperature of about 0.6 to 0.8 times the melting point of the metal used.

11. Process according to claim 10, characterized in that the mixture is injected around a core pin in the injection moulding tool and is joined to this core pin during sintering.

12. Sintered electrode according to claim 2, characterized in that the particle size distribution covers a range from at most 10% below to at most 10% above the mean.

13. Sintered electrode according to claim 3, characterized in that the particle size distribution covers a range from at most 10% below to at most 10% above the mean.

* * * * *